US011011080B2

(12) United States Patent
Engl

(10) Patent No.: US 11,011,080 B2
(45) Date of Patent: May 18, 2021

(54) ARRANGEMENT FOR INDICATING AN INTENDED END OF THE PERIOD OF USE OF A TEXTILE PRODUCT

(71) Applicant: Johannes Engl, Bildstein (AT)

(72) Inventor: Johannes Engl, Bildstein (AT)

( * ) Notice: Subject to any disclaimer, the term of this patent is extended or adjusted under 35 U.S.C. 154(b) by 705 days.

(21) Appl. No.: 15/571,145

(22) PCT Filed: Apr. 15, 2016

(86) PCT No.: PCT/AT2016/000037
§ 371 (c)(1),
(2) Date: Nov. 1, 2017

(87) PCT Pub. No.: WO2016/179613
PCT Pub. Date: Nov. 17, 2016

(65) Prior Publication Data

US 2018/0174494 A1 Jun. 21, 2018

(30) Foreign Application Priority Data

May 13, 2015 (AT) ..... A 298/2015

(51) Int. Cl.
*G09F 3/00* (2006.01)
*D06H 1/04* (2006.01)
*D06H 1/00* (2006.01)

(52) U.S. Cl.
CPC ..... *G09F 3/0291* (2013.01); *D06H 1/00* (2013.01); *D06H 1/04* (2013.01); *D06H 1/046* (2013.01)

(58) Field of Classification Search
CPC ..... G09F 3/0291; D06H 1/00; D06H 1/04; D06H 1/046; D06H 3/02
See application file for complete search history.

(56) References Cited

U.S. PATENT DOCUMENTS 3,030,227 A * 4/1962 Clifford ..... D06P 1/0004 428/207
3,633,294 A * 1/1972 Burmeister ..... A41D 27/00 40/638

(Continued)

FOREIGN PATENT DOCUMENTS

AU 2012203875 1/2013
CH 697470 10/2008

(Continued)

OTHER PUBLICATIONS

International Standard, ISO 105-C06, "Textiles—Tests, for Colour Fastness—, Part C06: Colour fastness to domestic and commercial laundering", Fourth Edition, Mar. 15, 2010, 14 pgs.

*Primary Examiner* — Nimeshkumar D Patel
*Assistant Examiner* — Tania Courson
(74) *Attorney, Agent, or Firm* — Volpe Koenig

(57) ABSTRACT

In an arrangement for indicating an intended end of a period of use of a textile product (1), the textile product (1) or a label (2) of the textile product (1) has an indicator field (3) which, in a first area (3*a*), has a first color that changes during the period of use of the textile product (1) and in the course of the associated washes. The indicator field (3) additionally has a second color in a second area (3*b*), wherein the wash-fastness of the first color is less than the wash-fastness of the second color, and the first color differs, in the delivery state, from the second color and, over a number of washes of the textile product (1), increasingly approximates to the second color.

10 Claims, 2 Drawing Sheets

(56) References Cited

U.S. PATENT DOCUMENTS

| | | | | |
|---|---|---|---|---|
| 4,678,704 | A * | 7/1987 | Fellows | D06M 13/00 442/121 |
| 5,293,648 | A * | 3/1994 | Finley | D06P 1/004 116/206 |
| 5,388,331 | A * | 2/1995 | Doroodian-Shoja | B26B 21/4087 116/208 |
| 5,906,834 | A * | 5/1999 | Tseng | A46B 11/00 15/104.93 |
| 6,501,002 | B1 * | 12/2002 | Roe | A47K 7/00 422/402 |
| 8,772,184 | B2 * | 7/2014 | Farrugia | A01N 25/34 442/59 |
| 9,475,952 | B2 * | 10/2016 | Jelonek | A47L 13/17 |
| 9,578,908 | B2 * | 2/2017 | Berns | A43B 1/10 |
| 10,098,447 | B2 * | 10/2018 | Newman | A46B 9/06 |
| 10,378,875 | B2 * | 8/2019 | Cranin | A41D 13/0015 |
| 2005/0125926 | A1 * | 6/2005 | Rekum | A47L 13/16 15/208 |
| 2008/0113868 | A1 | 5/2008 | Moore et al. | |
| 2009/0064919 | A1 | 3/2009 | Greenwald | |
| 2010/0293734 | A1 | 11/2010 | Driesen et al. | |
| 2014/0109362 | A1 | 4/2014 | Bassi | |
| 2014/0115748 | A1 | 5/2014 | Berns et al. | |

FOREIGN PATENT DOCUMENTS

| | | |
|---|---|---|
| CN | 204292259 | 4/2015 |
| DE | 102006031138 | 1/2008 |
| DE | 112007002683 | 10/2009 |
| EP | 2198744 | 12/2008 |
| EP | 2082967 | 7/2009 |
| FR | 2783959 | 3/2000 |
| WO | 8603613 | 6/1986 |

* cited by examiner

ARRANGEMENT FOR INDICATING AN INTENDED END OF THE PERIOD OF USE OF A TEXTILE PRODUCT

BACKGROUND

The invention relates to an arrangement for indicating the intended end of a period of use of a textile product, wherein the textile product or a label of the textile product has an indicator field which in a region has a color that changes in the course of the period of use of the textile product and of the washing procedures associated therewith.

The cleaning effect in the case of cleaning cloths wears off after a prolonged period of use. Since this takes place in a subtle manner, it is difficult for the user to identify when a favorable point in time for replacing the cleaning cloth has been reached. A sales representative, for example, can also assess only with difficulty whether a replacement of the cleaning cloth is to be recommended.

Other textile products, for example bed linen in hospitals, also have to be replaced after an intended period of use. Marking the products and keeping track of the period of use of the latter is complex especially when products are employed which have been used for different periods of time.

An arrangement of the type mentioned at the outset is described in DE 10 2006 031 138 A1. It is described that in order for the wear or the period of use of items, in particular textiles, to be checked, said items are equipped with an identification feature which changes in a manner dependent on the time, dependent on the number of washing cycles or cleaning cycles, or dependent on the influence of light, sweat, moisture, skin particles, or heat, and the change in said identification feature being detectable. A change in color which arises in the course of a number of washing procedures can inter alia be provided. To this end, a multi-layered construction of the identification feature is mentioned, wherein the topmost and then the layers therebelow are successively removed or washed away by way of progressive washing. The number of washes and thus the wear of the item of clothing can thus be visually determined for example in a simple manner by virtue of the different physical or chemical properties such as, for example, the color of the individual layers. Checking for any change can be performed by a color scale, for example, or by special, for example spectroscopic, measuring apparatuses. Disadvantages herein lie inter alia in that checking by special measuring apparatuses is complex and that such measuring apparatuses have to be available. In the case of checking with a color scale, the latter has to be stored separately and can be easily lost in particular in the case of a retail consumer. Also, gradual changes in color in the course of washing are hardly apparent to a user, in particular when these are color nuances of the same color, such that checking has to be carried out at regular intervals, or the end of the intended period of use can be easily overlooked, respectively.

SUMMARY

It is an object of the invention to provide an advantageous arrangement of the type mentioned at the outset by way of which an intended end of the period of use of the textile product is able to be established in a simple manner. This is achieved by an arrangement having one or more features of the invention.

The invention proceeds from the basic concept of determining the end of the intended period of use by the washing procedures of the textile product performed and of using to this end an indicator field which in a first region has a first color, and in a second region has a second color, wherein the wash-fastness of the first color is lower than the wash-fastness of the second color. In the course of the period of use and of the washing procedures associated therewith a relative change between the color of the first region and the color of the second region thus takes place, wherein the first color in the shipped state of the textile product differs from the second color, and over a number of washing procedures of the textile product increasingly approximates the second color. Due to this, an intended end of the period of use can be visually indicated in a simple manner to the user or to another person assessing the textile product.

The first color after a number of washing procedures is preferably identical to the second color. Due to this, the intended end of the period of use can be indicated in a clearly recognizable way.

The second color favorably has such a high wash-fastness that said color over the period of use of the textile product remains unchanged or at least substantially unchanged.

The wash-fastness is a usual specification pertaining to a change of color when washing the textile product.

In order for the wash-fastness to be assessed, the textile product can be washed in a conventional domestic washing machine, using a conventional domestic laundry detergent, at an intended temperature, preferably 60° C., in order for changes in color to be assessed after one or a plurality of washes. The saturation of the color can change in particular. When the dye that causes the color comprises two or more components of different colors which can be washed out to a dissimilar degree, the shade of the color can change too.

A standard laundry detergent, in particular the AATCC (American Association of Textile Chemists and Colorists) 1993 standard laundry detergent WOB, can favorably be used in order for the wash-fastness to be determined.

The wash-fastness can be determined in particular according to ISO standard 105-006:2010 (E). The aforementioned standard reference laundry detergent is used herein. The washing procedure is preferably performed according to test number C1S of this standard, and thus at a temperature of 60° C.

Yarns comprising wash-fast colors and yarns comprising colors that are not wash-fast and which can be used in the context of the present invention are well known.

The textile product can be, for example, a cleaning cloth, for example a cleaning cloth which comprises microfibers or is comprised entirely of microfibers. However, other types of textile products can also be configured in a manner according to the invention.

BRIEF DESCRIPTION OF THE DRAWINGS

Further advantages and details of the invention will be explained hereunder by means of the appended drawing. In the drawings.

DETAILED DESCRIPTION OF THE PREFERRED EMBODIMENTS

Figure 1:
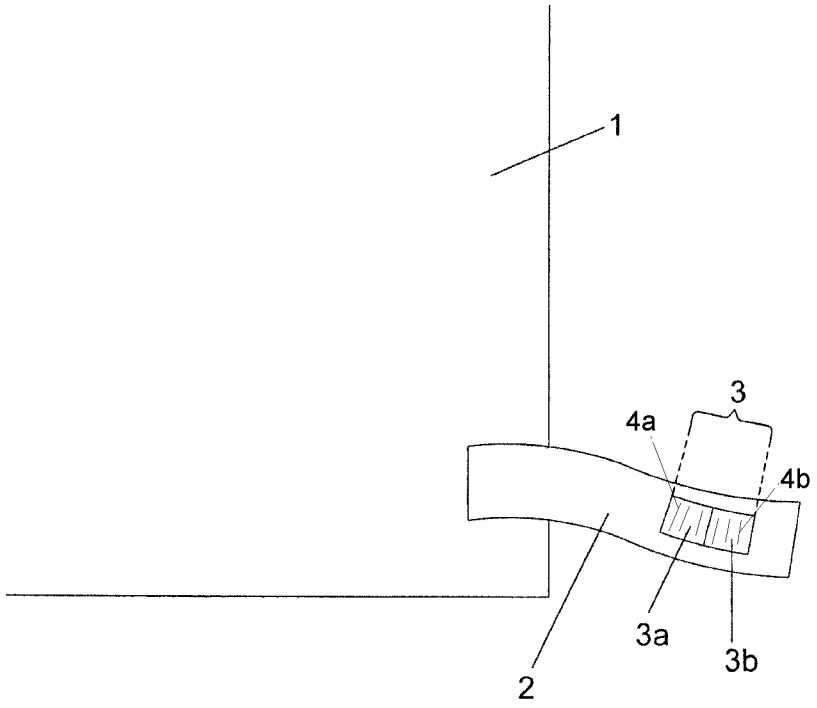
FIG. 1 shows a schematic illustration of an exemplary embodiment of the invention.

FIG. 1 shows a portion of a textile product 1 to which a label 2 is attached. The label 2 has an indicator field 3 having a first region 3*a* and a second region 3*b*. The label 2 in the first region 3*a* comprises a yarn 4*a* having a first color. The label 2 in the second region 3*b* comprises a yarn 4*b* having a second color. Based on this, the first region 3*a* has the first color, and the second region 3*b* has the second color, wherein the colors of the regions 3*a* and 3*b* in the shipped state are different.

In order for a ready comparison between the colors of the regions 3*a* and 3*b* to be possible, the regions 3*a* and 3*b* in the exemplary embodiment shown are directly contiguous, as is preferred.

The wash-fastness of the color of the region 3*a* is substantially lower than the wash-fastness of the color of the region 3*b*. Therefore, a substantially more intense change in the color of the region 3*a* than of the region 3*b* arises over a multiplicity of washing procedures of the textile product 1 including the label 2. The color of the region 3*b* preferably remains at least substantially unchanged. Over the multiplicity of washing procedures the color of the region 3*a* increasingly approximates the color of the region 3*b*. After a number of washing procedures, said number potentially being in the range from 50 to 300 for example, the color of the region 3*a* is preferably identical to the color of the region 3*b*.

The color of the region 3*a* in the shipped state is in particular darker than the color of the region 3*b*. Once the number of washing procedures at which the colors of the regions 3*a* and 3*b* are identical has been exceeded, the region 3*a* in relation to the region 3*b* becomes increasingly lighter due to further washing procedures of the textile product.

The color shade of the region 3*a* can also change over the number of washing procedures when the dye by way of which the yarn of the region 3*a* is dyed comprises a plurality of components of different colors which wash out to a dissimilar degree.

For example, the color of the first region 3*a* in the shipped state can be black. On account thereof, the change in color and the approximation toward the color of the region 3*b* can be readily identifiable. For example, the region 3*b* (in the shipped state and after the number of washing procedures) can be blue. However, other colors of the region 3*a* and/or region 3*b* in the shipped state are also conceivable and possible.

For example, the yarn 4*a* having the first color that is provided in the first region 3*a* can be configured from polyamide. Other yarns, in particular man-made yarns, can also be used.

The yarn 4*b* having the second color that is provided in the second region 3*b* can be composed of polyester, for example. Other yarns, in particular man-made yarns, can also be used.

The textile product 1 can in particular be a cleaning cloth, for example a cleaning cloth that has a protruding pile.

A potential configuration of the cleaning cloth provides that the latter is composed of microfibers or comprises such microfibers. However, the cleaning cloth can also have only fibers that are thicker when compared to said microfibers.

When the textile product 1 is washed at a temperature that is higher than the intended temperature of, 60° C., for example, this will generally lead to the change in color of the first region 3*a* in relation to the second region 3*b* being intensified. Due to this, the end of the intended period of use is indicated after fewer washing procedures. The wear of the textile product 1 at higher washing temperatures is generally also increased such that the expedient period of use of the textile product is reduced.

On the other hand, in the case of a relatively new product in which the end of the intended period of use can be read from the indicator field 3, it can be concluded that the textile product has been washed at a higher temperature than the intended temperature of 60° C., for example.

The wash-fastness of the respective region 3*a*, 3*b* can be determined in particular according to international standard ISO 105-006:2010 (E) (this is the fourth edition of this ISO standard, published Mar. 15, 2010).

According to this standard, a rotatable shaft which radially supports a (cylindrical) stainless steel container having a diameter of 75±5 mm and a height of 125±10 mm and a volume of 550±50 ml is provided, wherein the base of the container lies 45±10 mm away from the longitudinal central axis of the shaft. The container is rotated at a frequency of 40±2 revolutions per minute.

Test C1S of this standard, in which washing is performed at a temperature of 60° C. (±2° C.) is preferably performed. The washing procedure is carried out over 30 minutes, and 25 stainless steel balls having a diameter of 6 mm are added. The volume of liquid filled into the container is 50 ml.

A specimen having the dimensions 100±2 mm×40±2 mm is washed.

An adjacent woven multifilament fabric (composed of triacetate and viscose, according to ISO 105-A01 and 105-F10) having the same dimensions is attached to the specimen by sewing along one of the shorter edges. Since the point in this case is not the migration of dye to another woven fabric, this adjacent woven fabric can also be omitted.

The AATCC 1993 standard laundry detergent WOB (without optical brighteners) is used as the laundry detergent. The exact composition of this reference laundry detergent WOB is listed in detail in the standard mentioned.

The suds are produced in that 4 g of the standard laundry detergent WOB are dissolved per liter of water (water hardness level 3, according to ISO 3696). The pH value is set to 10.5±0.1 by adding approx. 1 g of sodium bicarbonate.

Once filled with the specimen, the stainless steel balls, and the suds, the container is closed and the washing procedure is carried out at the intended temperature over the intended duration.

After the washing procedure has ended, the washed specimen is rinsed twice in each case for one minute in two separate quantities of 100 ml of water at 40° C. Excess water is subsequently removed and the specimen is air dried at a temperature of less than 60° C. The change in color is subsequently determined. In particular, a spectrophotometer or a colorimeter according to ISO 105-A05:1996 can be used.

The wash-fastness of the color of the second region 3*b* is preferably so high that after 150 washing procedures according to test C1S of the standard mentioned the color of the second region 3*b* in terms of the saturation, the shade, and the brightness parameter thereof has changed in each case by less than 5% in relation to the CIE color space (CIE 1931).

The difference in the wash-fastness of the color of the region 3*a* and the wash-fastness of the color of the region 3*b* is preferably so large that after 150 washing procedures according to test C1S of the standard mentioned the change in the saturation of the color of the region 3*a* is at least double the change in the saturation of the color of the region 3*b*, and/or the change in the color shade of the color of the region 3*a* is at least double the change in the color shade of the color of the region 3*b* and/or the change in the brightness parameter of the color of the region 3*a* is at least double the change in the brightness parameter of the color of the region 3*b*, in each case in relation to the CIE color space (CIE 1931).

In one advantageous configuration of the invention the color of the region 3*a* after a number of washing procedures according to test C1S of the standard mentioned that is in the range from 50 to 300, preferably in the range from 100 to 200, is identical or at least substantially identical to the color of the region 3*b*. That the colors are substantially identical herein is to mean that the saturation, the color shades, and the brightness parameters of said colors in the CIE color space (CIE 1931) in each case differ by less than 5%.

The label 2 in the exemplary embodiment shown has the indicator field 3. In principle, the textile product 1 per se could also be provided with such an indicator field.

Figure 2:
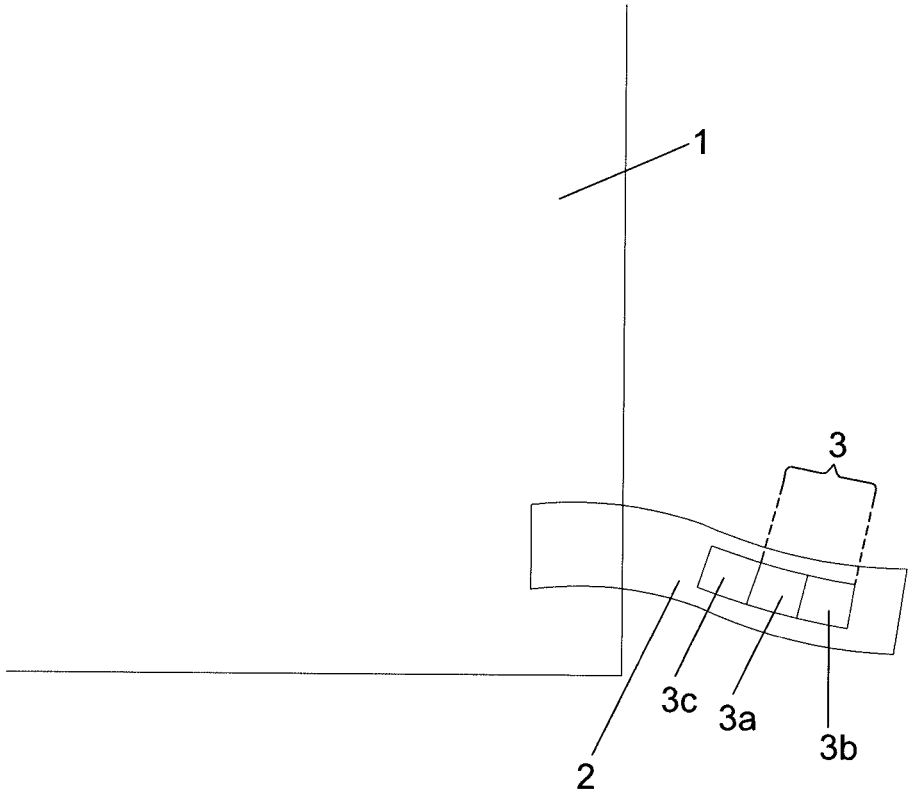
FIG. 2 shows a modification thereof.

FIG. 2 shows a modified exemplary embodiment. The difference in relation to the previously described exemplary embodiment lies merely in that the indicator field here, in addition to the first region 3*a* and to the second region 3*b*, has a third region 3*c*. The indicator field 3 in the third region 3*c* has a third color. The wash-fastness of the first color is lower than the wash-fastness of the third color, and the first color in the shipped state is identical to the third color.

The third color favorably has a wash-fastness that is so high that said third color over the period of use of the textile product remains unchanged or at least substantially unchanged. The wash-fastness of the color of the third region 3*c* is preferably so high that after 150 washing procedures according to test C1S of the standard mentioned the color of the third region 3*c* in terms of the saturation, the color shade, and the brightness parameter thereof in each case has changed by less than 5% in relation to the CIE color space (CIE 1931).

The user can thus establish in a simple manner how intensely the first color deviates from the third color. By a comparison between the first color and the third color and the second color it can be made clear in a particularly positive manner to the user or to another person assessing the textile product how much of the intended period of use of the textile product has already expired.

The region 3*a* preferably lies between the regions 3*c* and 3*b*. The regions 3*c*, 3*a* and 3*b* are preferably directly contiguous.

LIST OF REFERENCE SIGNS

1 Textile product
2 Label
3 Indicator field
3*a* First region
3*b* Second region
3*c* Third region
4*a* Yarn having a first color
4*b* Yarn having a second color

The invention claimed is:

1. An arrangement for indicating an intended end of a period of use of a textile product, comprising an indicator field which in a first region has a color that changes in the course of a period of use of the textile product and of washing procedures associated therewith, the indicator field in addition to the first region in which said indicator field has the first color that changes in the course of the period of use of the textile product and of the washing procedures associated therewith, includes a second region, separate from the first region, that has a second color, and a wash-fastness of the first color is lower than a wash-fastness of the second color, and the first color in a shipped state differs from the second color, and over a number of washing procedures of the textile product is adapted to increasingly approximate the second color; and wherein the first region of the indicator field comprises a first textile material including a first yarn having the first color, and the second region of the indicator field comprises a second textile material including a second yarn having the second color.

2. The arrangement as claimed in claim 1, wherein the first color after a number of washing procedures is identical to the second color.

3. The arrangement as claimed in claim 1, wherein the first color in the shipped state is black.

4. The arrangement as claimed in claim 1, wherein the second region is contiguous to the first region.

5. The arrangement as claimed in claim 1, wherein the textile product is a cleaning cloth.

6. The arrangement as claimed in claim 5, wherein the textile product comprises microfibers or consists entirely of microfibers.

7. The arrangement as claimed in claim 1, wherein the indicator field includes a third region that has a third color, and the first color in the shipped state is identical to the third color, and the wash-fastness of the first color is lower than a wash-fastness of the third color.

8. The arrangement as claimed in claim 7, wherein the third region is contiguous to the first region.

9. The arrangement as claimed in claim 7, wherein the first region lies between the third region and the second region.

10. The arrangement as claimed in claim 1, wherein the indicator field is included in a label of a textile product.

* * * * *